US009914203B2

(12) United States Patent
Orine, III

(10) Patent No.: US 9,914,203 B2
(45) Date of Patent: Mar. 13, 2018

(54) CONNECTABLE TOOL ASSEMBLY

(71) Applicant: Francisco E. Orine, III, Imperial, MO (US)

(72) Inventor: Francisco E. Orine, III, Imperial, MO (US)

( * ) Notice: Subject to any disclaimer, the term of this patent is extended or adjusted under 35 U.S.C. 154(b) by 217 days.

(21) Appl. No.: 14/808,452

(22) Filed: Jul. 24, 2015

(65) Prior Publication Data

US 2016/0023345 A1 Jan. 28, 2016

Related U.S. Application Data

(60) Provisional application No. 62/028,452, filed on Jul. 24, 2014.

(51) Int. Cl.
*B25F 1/00* (2006.01)
*B25C 11/00* (2006.01)

(52) U.S. Cl.
CPC ..... *B25F 1/006* (2013.01); *B25C 11/00* (2013.01)

(58) Field of Classification Search
CPC .... B25F 1/006; B25F 1/00; B25F 1/02; B25F 1/04; B25C 11/00; B66F 15/00
See application file for complete search history.

(56) References Cited

U.S. PATENT DOCUMENTS 3,824,641 A * 7/1974 Shandel ..... B25F 1/02 403/373
2002/0138915 A1* 10/2002 Corsini ..... B26B 23/00 7/143
2015/0113738 A1* 4/2015 Wells ..... A62B 3/005 7/166

* cited by examiner

*Primary Examiner* — Robert Scruggs
(74) *Attorney, Agent, or Firm* — Global Intellectual Property Agency, LLC; Daniel Enea

(57) ABSTRACT

A tool assembly including a hammer to which a secondary tool, such as a dual-ended pry bar, is connectable. The hammer and the secondary tool are connectable via a slidable locking mechanism, including a detent pin that engages with a corresponding slot on a rail disposed on the secondary tool. One embodiment of the secondary tool includes multiple rails, which allows for the secondary tool to be attached to the hammer in multiple different orientations. The different orientations in which the secondary tool can be connected to the hammer allows for the first working end of the secondary tool or the second working end of the tool to be used alternatively as needed.

8 Claims, 3 Drawing Sheets

CONNECTABLE TOOL ASSEMBLY

CROSS REFERENCE TO RELATED APPLICATIONS

This application claims the benefit of U.S. Provisional Application No. 62/028,452 filed on Jul. 24, 2014. The above identified patent application is herein incorporated by reference in its entirety to provide continuity of disclosure.

FIELD OF THE INVENTION

The present invention relates to tools. Specifically, the present invention relates to an assembly of tools that are connectable together.

BACKGROUND OF THE INVENTION

Construction workers, repairmen, and other such individuals who routinely work with tools are force to carry multiple different tools with them at all times in order to handle the variety of tasks with which they are faced. Furthermore, conventional pry bars are often not long enough to provide sufficient leverage to efficiently remove fasteners from dug-in positions. Therefore, there is a need in the prior art for a tool assembly that provides the functionality of multiple tools in an efficient manner and, for embodiments of the present invention comprising a pry bar, provides a pry bar having an extended length for improved leverage.

SUMMARY OF THE INVENTION

In view of the foregoing disadvantages inherent in the known types of connectable tool assemblies now present in the prior art, the present invention provides a novel connectable tool assembly that is configured to provide users with a means to connect a secondary tool to a hammer in multiple different working positions. An embodiment of the present invention comprises a tool assembly including a hammer to which a secondary tool, such as a dual-ended pry bar, is connectable. The hammer and the secondary tool are connectable via a slidable locking mechanism, including a detent pin that engages with a corresponding slot on a rail disposed on the secondary tool. The secondary tool includes multiple rails, which allows for the secondary tool to be attached to the hammer in multiple different orientations. The different orientations in which the secondary tool can be connected to the hammer allows for the first working end of the secondary tool or the second working end of the tool to be used alternatively as needed.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
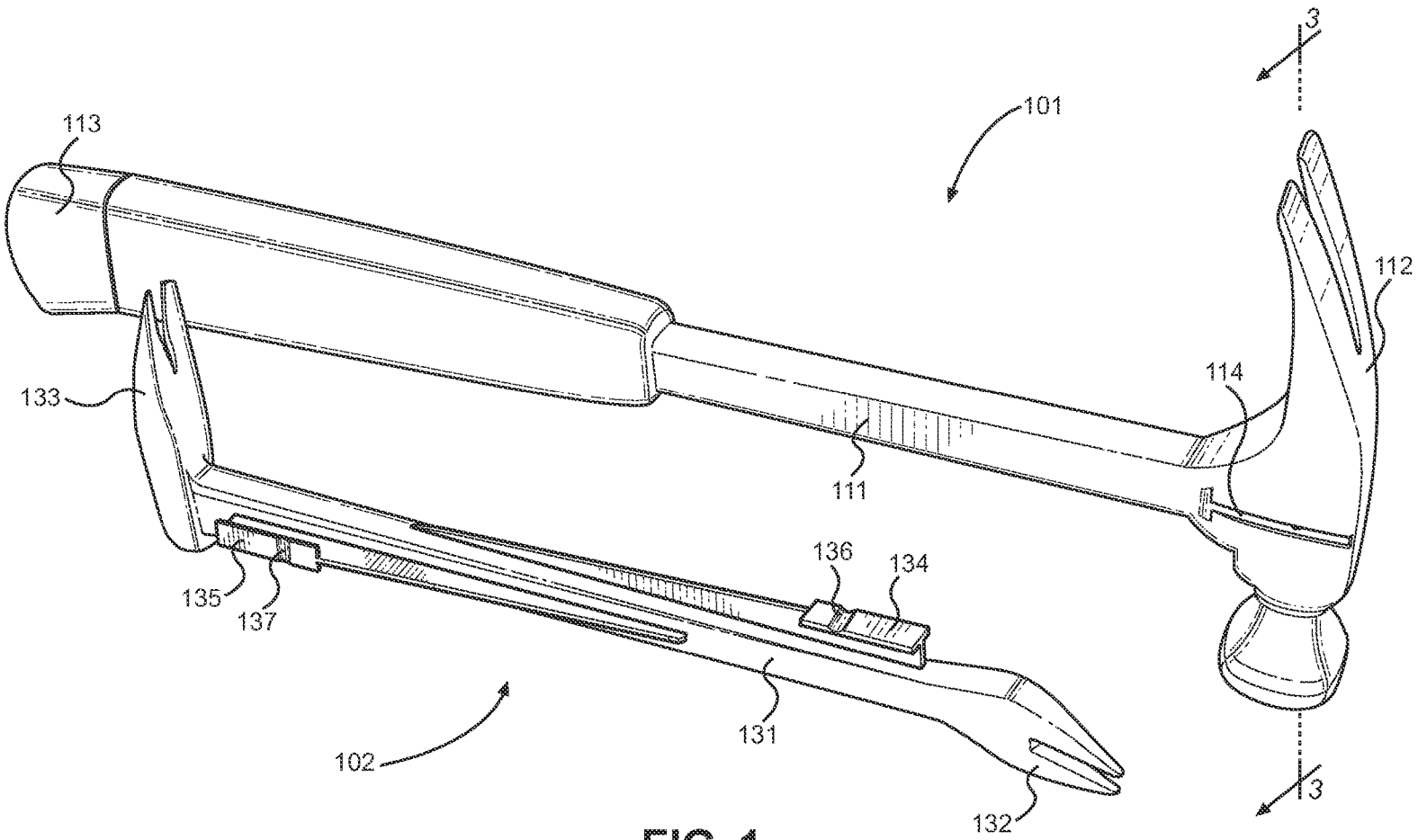
FIG. 1 shows a perspective view of an embodiment of the present invention.

Reference is made herein to the attached drawings. Like reference numerals are used throughout the drawings to depict like or similar elements of the present tool assembly. For the purposes of presenting a brief and clear description of the present invention, an embodiment will be discussed as the first tool being a hammer and the second tool being a dual-ended pry bar; however, this is provided solely for representative purposes and should not be read as limiting in any respect. Furthermore, the figures are intended for representative purposes only and should not be considered to be limiting in any respect.

Figure 2:
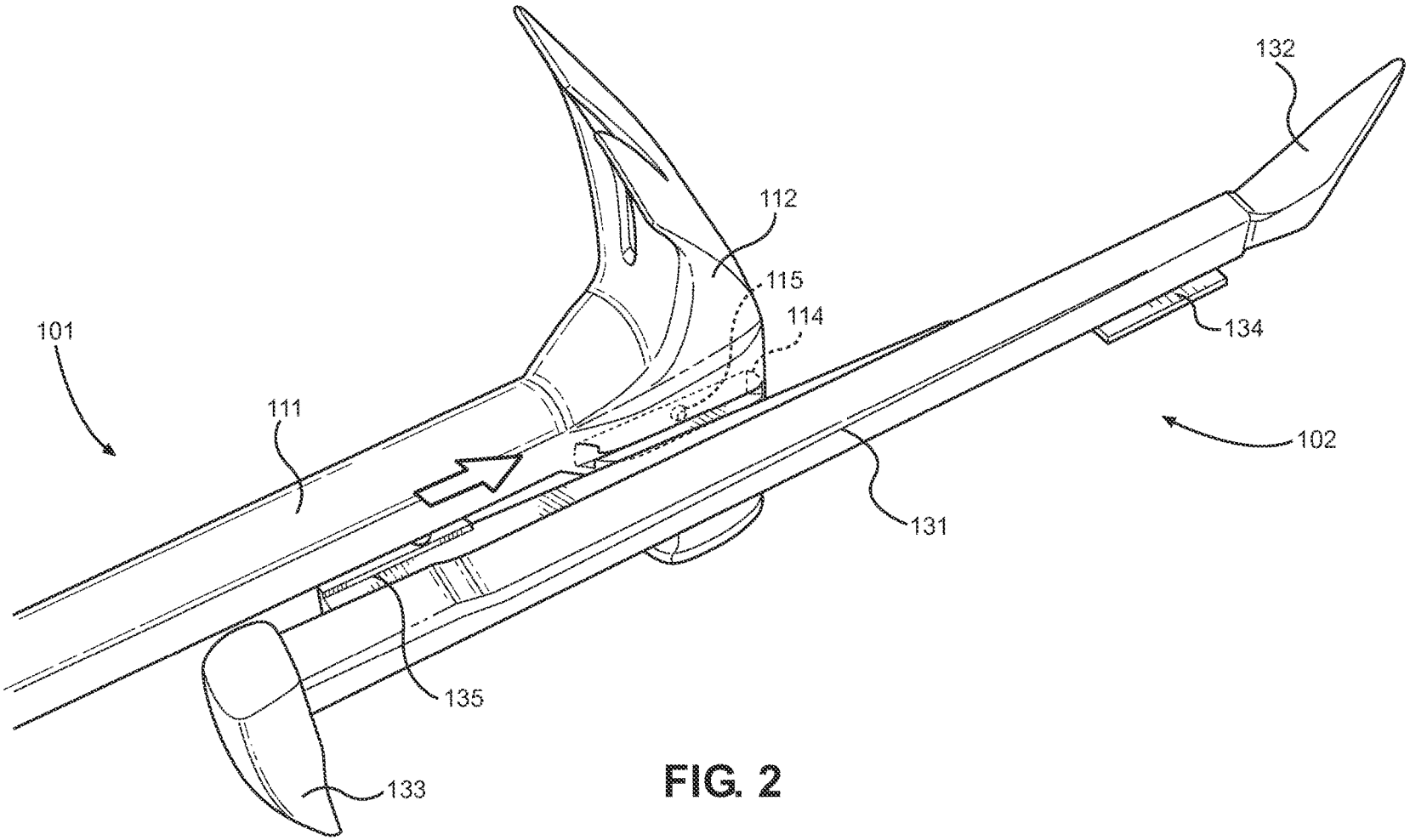
FIG. 2 shows a perspective view of an embodiment of the present invention wherein the hammer is slidably engaging with the secondary tool.

Referring now to FIGS. 1-2, there are shown perspective views of an embodiment of the present invention. An embodiment of the present invention comprises a hammer 101 to which a secondary tool 102 is connectable. The hammer 101 comprises a shaft 111 having a handle or grip and a head 112 having a striking surface. The hammer 101 comprises a claw hammer, as shown, and all other such hammers. The secondary tool 102 comprises a shaft 131, a first working end 132 disposed at a first end of the shaft 131, and a second working end 133 disposed at a second end of the shaft 131. The secondary tool 102 is connectable to the hammer 101 in alternative orientations, allowing for use of the first working end 132 or the second working end 133 as desired. In an illustrative embodiment of the present invention, the secondary tool 102 comprises a dual-ended pry bar. As used herein, "working end" refers to the section of a tool that is used to accomplish the task for which the tool was designed.

The secondary tool 102 is connectable to the hammer 101 via a slidable locking mechanism. The hammer 101 comprises a channel 114 disposed on the head 112 that is configured to receive a first rail 134 and a second rail 135, which are disposed on the shaft 131 of the secondary tool 102. The channel 114 further comprises a spring-biased detent pin 115 disposed therein, which is configured to engage with a slot 136, 137 disposed on the rails 134, 135. As the rail 134, 135 is slid into the slot 136, 137, the rail 134, 135 depresses the detent pin 115 until the detent pin 115 is aligned with the slot 136, 137, at which point the detent pin 115 engages with the slot 136, 137 and locks the secondary tool 102 to the head 112 of the hammer 101. When the hammer 101 and the secondary tool 102 are connected together, the locking mechanism prevents the hammer 101 and the secondary tool 102 from moving longitudinally with respect to each other until the detent pin 115 is disengaged.

The rails 134, 135 are sized to a close tolerance of the channel 114, thereby preventing lateral movement of the rails 134, 135 within the channel 114 with respect to the longitudinal axis of the hammer 101, while allowing the channel 114 to slidably receive the rails 134, 135 therein. In an illustrative embodiment of the present invention, the channel 114 and the rails 134, 135 are T-shaped. As used herein, "close tolerance" refers to there being sufficient clearance between components such that they are movable in relation to each other in one direction, e.g. longitudinally, but the physical dimensions being nearly equal such that, when engaged, the components are prevented from moving in a second direction, e.g. laterally. In this embodiment of the present invention, the T-shaped channel 114 can additionally be used as a means for pulling nails by inserting the exposed head of the nail into the channel 114 and then pivoting the hammer 101 upwardly.

In an illustrative embodiment of the present invention, the first rail 134 is disposed on the shaft 131 adjacently to the first working end 132 such that when the first rail 134 is engaged with the channel 114, the second working end 133 extends beyond the head 112 of the hammer 101 and is thereby usable. Furthermore, the second working end 135 is disposed on the shaft 131 adjacently to the second working end 133 such that when the second rail 133 is engaged with the channel 114, the first working end 132 extends beyond the head 112 of the hammer 101 and is thereby usable. In an illustrative embodiment of the present invention, the first rail 134 and the second rail 135 are oriented perpendicularly to each other along the shaft 131 of the secondary tool 102, thereby ensuring that when one of the working ends 132, 133 is in use, the working end 132, 133 not in use is oriented away from the shaft 111 of the hammer 101 so that it does not interfere with the connection between the rail 134, 135 and the channel 114.

An alternative embodiment of the present invention further comprises a cap 113 composed of hardened material, e.g. steel, disposed at the distal end of the shaft 111 of the hammer 101. The cap 113 provides a hardened surface that can be struck against another surface to assist in disconnecting the secondary tool 102 from the hammer 101, without causing damage to the hammer 101. The sharp vertical force supplied by striking the hammer 101 against a surface assists in disengaging the detent pin 115 from the slot 136, 137 of the rail 134, 135 that is disposed within the channel 114. Once the detent pin 115 is disengaged from the slot 136, 137, the rail 134, 135 can then be slid from the channel 114, disconnecting the secondary tool 102 from the hammer 101.

Figure 3B:
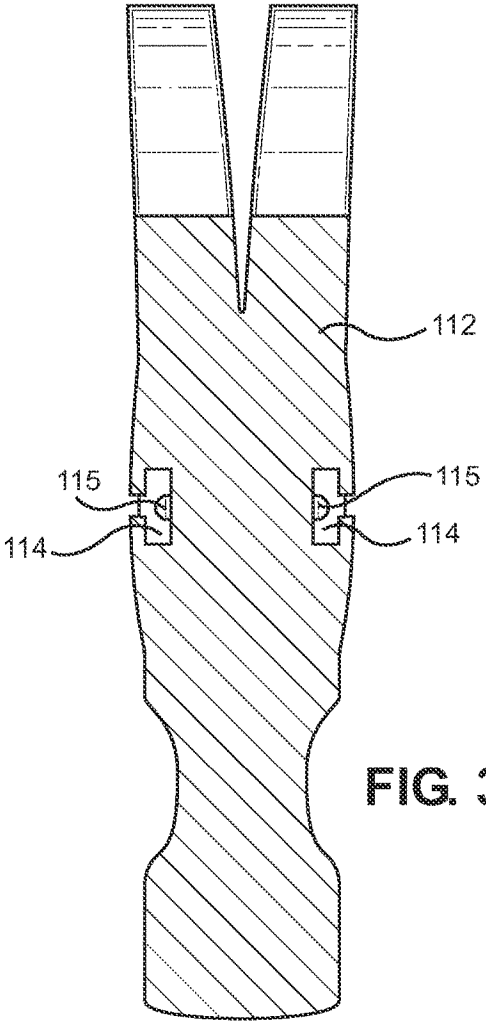
FIG. 3B shows a cross-sectional view of embodiment of the head portion of the hammer of the present invention along line 3-3.
Figure 3A:
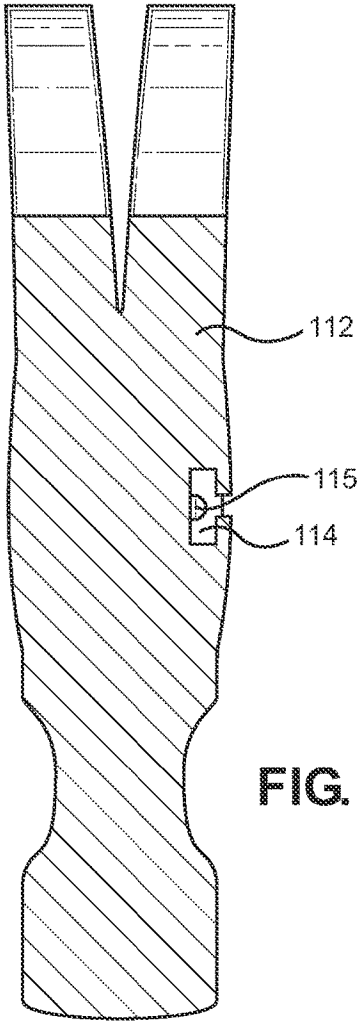
FIG. 3A shows a cross-sectional view of embodiment of the head portion of the hammer of the present invention along line 3-3.

Referring now to FIGS. 3A-3B, there are shown cross-sectional views of alternative embodiments of the head portion of the hammer of the present invention along line 3-3. In one embodiment of the present invention, the head 112 of the hammer comprises a single slot disposed on a first side of the head 112. In another embodiment of the present invention, as shown in FIG. 3B, the head 112 of the hammer comprises a pair of channels 114 disposed on opposing sides of the head 412. Each of the channels 114 comprises a detent pin 115 and is configured to receive a rail of the secondary tool for connecting the secondary tool to the hammer, as is described above with respect to the single-channel embodiment of the present invention.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tool assembly, comprising:

a hammer comprising a shaft, a head, and a channel;

a secondary tool comprising a first working end, a second working end, a first rail, and a second rail;

wherein the first working end is disposed adjacent to the first rail and the second working end is disposed adjacent to the second rail;

wherein the first rail and the second rail are disposed perpendicularly with respect to each other;

each of the first rail and the second rail comprising a slot;

wherein the channel is configured to slidably receive one of the first rail and the second rail;

wherein the distance between the first working end and the head is less than the distance between the second working end and the head when the first rail is engaged with the channel;

wherein the distance between the second working end and the head is less than the distance between the first working end and the head when the second rail is engaged with the channel;

wherein the slot is configured to engage a detent pin.

2. The tool assembly of claim 1, wherein a distal end of the shaft is fabricated from a hardened material.

3. The tool assembly of claim 1, wherein the secondary tool comprises a dual-ended pry bar.

4. The tool assembly of claim 1, wherein:

the first rail and the second rail comprise T-shaped members;

the channel comprises a T-shaped channel;

the T-shaped channel is sized to a close tolerance of the T-shaped members.

5. The tool assembly of claim 1, wherein the channel is disposed on the head.

6. The tool assembly of claim 5, further comprising a second channel disposed on an opposite side of the head from the channel.

7. The tool assembly of claim 1, wherein the first working end is oriented perpendicularly to the second working end.

8. The tool assembly of claim 1, wherein the second tool is configured such that the first working end extends beyond the head when the hammer and the head are connected via the second rail.

* * * * *